US005679505A

United States Patent [19]

Tingler et al.

[11] Patent Number: 5,679,505

[45] Date of Patent: Oct. 21, 1997

[54] PHOTOGRAPHIC ELEMENT USEFUL AS A MOTION PICTURE PRINT FILM

[75] Inventors: Kenneth Lloyd Tingler, Rochester; Charles Chester Anderson, Penfield; Lori Jeanne Shaw-Klein, Rochester, all of N.Y.

[73] Assignee: Eastman Kodak Company, Rochester, N.Y.

Related U.S. Application Data

[60] Provisional application No. 60/006,179 Nov. 2, 1995.

[21] Appl. No.: 576,796

[22] Filed: Dec. 21, 1995

[51] Int. Cl.[6] ..... G03C 1/76

[52] U.S. Cl. ..... 430/523; 430/527; 430/529; 430/530; 430/533; 430/538; 430/631; 430/950; 430/510; 430/517; 430/632; 430/633; 430/634; 430/635; 430/636; 430/637; 430/638

[58] Field of Search ..... 430/523, 527, 430/529, 530, 533, 538, 631, 950, 502, 510, 517, 632–638

[56] References Cited

U.S. PATENT DOCUMENTS

| | | | |
|---|---|---|---|
| 2,271,234 | 6/1942 | Staud et al. | 430/523 |
| 2,327,828 | 3/1943 | Simmons | 430/513 |
| 3,885,080 | 5/1975 | Lambert et al. | 430/533 |
| 4,497,917 | 2/1985 | Upson et al. | 523/201 |
| 4,914,018 | 4/1990 | Besio et al. | 430/528 |
| 4,997,735 | 3/1991 | Nitschke et al. | 430/22 |
| 5,006,451 | 4/1991 | Anderson et al. | 430/527 |
| 5,122,445 | 6/1992 | Ishigaki | 430/523 |
| 5,208,139 | 5/1993 | Ishigaki | 430/523 |
| 5,221,598 | 6/1993 | Anderson et al. | 430/527 |
| 5,310,640 | 5/1994 | Markin et al. | 430/527 |
| 5,360,706 | 11/1994 | Anderson et al. | 430/529 |
| 5,366,855 | 11/1994 | Anderson et al. | 430/530 |
| 5,380,630 | 1/1995 | Mochizuki et al. | 430/523 |
| 5,411,844 | 5/1995 | Orem | 430/527 |
| 5,457,013 | 10/1995 | Christian et al. | 430/496 |
| 5,541,048 | 7/1996 | Whitesides et al. | 430/631 |

*Primary Examiner*—Geraldine Letscher

*Attorney, Agent, or Firm*—Carl F. Ruoff; Alfred P. Lorenzo

[57] ABSTRACT

A photographic film that is especially useful as a motion picture print film is comprised of a support having, in order, on one side thereof an antihalation undercoat and at least one silver halide emulsion layer and having, in order, on the opposite side thereof an antistatic layer and a protective topcoat; wherein the protective topcoat is comprised of a polyurethane binder and a lubricant and the polyurethane binder has a tensile elongation to break of at least 50% and a Young's modulus measured at 2% elongation of at least 50000 lb/in$^2$. The polyurethane binder provides a tough but flexible protective topcoat that is capable of resisting abrasion and scratching when the film is conveyed through a projector and capable of standing up to the repeated use to which motion picture print films are typically subjected.

22 Claims, No Drawings

PHOTOGRAPHIC ELEMENT USEFUL AS A MOTION PICTURE PRINT FILM

CROSS REFERENCE TO RELATED APPLICATION

Reference is made to and priority claimed from U.S. Provisional application Ser. No. U.S. 60/006,179, filed Nov. 2, 1995, entitled PHOTOGRAPHIC ELEMENT USEFUL AS A MOTION PICTURE PRINT FILM.

FIELD OF THE INVENTION

This invention relates in general to photography and in particular to a novel photographic element that is especially useful as a motion picture print film. More specifically, this invention relates to a photographic element having on one side of a support material, in order, an antihalation undercoat and one or more photographic emulsion layers and on the opposite side, in order, an antistatic layer and a protective topcoat.

BACKGROUND OF THE INVENTION

Motion picture photographic films that are used as print films for movie theater projection have long used a carbon black-containing layer on the backside of the film. This backside layer provides both antihalation protection and antistatic properties. The carbon black is applied in an alkali-soluble binder that allows the layer to be removed by a process that involves soaking the film in alkali solution, scrubbing the backside layer, and rinsing with water. This carbon black removal process, which takes place prior to image development, is both tedious and environmentally undesirable since large quantities of water are utilized in this film processing step. In addition, in order to facilitate removal during film processing, the carbon black-containing layer is not highly adherent to the photographic film support and may dislodge during various film manufacturing operations such as film slitting and film perforating. Carbon black debris generated during these operations may become lodged on the photographic emulsion and cause image defects during subsequent exposure and film processing.

After removal of the carbon black-containing layer the film's antistatic properties are lost. Undesired static charge build-up can then occur on processed motion picture print film when transported through projectors or on rewind equipment. Although these high static charges can discharge they cannot cause static marks on the processed photographic film. However, the high static charges can attract dirt particles to the film surface. Once on the film surface, these dirt particles can create abrasion or scratches or, if sufficiently large, the dirt particles may be seen on the projected film image.

These conventional carbon black-containing backing layers also typically contain a lubricant or are overcoated with a lubricant in order to improve conveyance during manufacturing operations or image exposure (i.e., printing). After processing, however, the lubricant is removed along with the carbon black and, therefore, processed print film has a high coefficient of friction on the backside of the film which is undesirable for good transport and film durability during repeated cycles through a movie theater projector.

The use of a carbon black-containing layer on the backside of motion picture films has been described, for example, in U.S. Pat. Nos. 2,271,234 and 2,327,828.

It is toward the objective of overcoming the aforesaid problems and limitations of the prior art, and providing a photographic film that is useful as a motion picture print film but does not utilize a carbon black-containing backside layer, that the present invention is directed.

SUMMARY OF THE INVENTION

In accordance with this invention, a photographic film, that is useful as a motion picture print film, comprises a support having, in order, on one side thereof an antihalation undercoat and at least one silver halide emulsion layer and having, in order, on the opposite side thereof an antistatic layer and a protective topcoat; wherein the protective topcoat is comprised of a polyurethane binder and a lubricant and the polyurethane binder has a tensile elongation to break of at least 50% and a Young's modulus measured at 2% elongation of at least 50000 lb/in$^2$.

The protective, abrasion-resistant topcoat on the backside of the film is effective both in maintaining the film's antistatic properties even after film processing and preventing damage to the backside of the film during the manufacture, processing, and repeated movie theater projection of the print film. In this discussion, "abrasion resistant" refers to the ability to prevent both surface abrasion, a scraping or rubbing away of the surface, usually through repetitive action, and scratching, a breaking of the surface which removes material from the surface or sub-surface, usually with a single action. A photographic film designed for movie theater projection must have a backing layer which is both hard and tough to prevent scratch and abrasion damage during several hundred cycles through a projector. Photographic film backings that are well known in the art, for example, polymethyl methacrylate and cellulose esters, although very hard materials, are too brittle for this application.

During the manufacture of the photographic film, the abrasion-resistant topcoat of the present invention protects the more fragile antistatic layer against abrasion or scratching which would otherwise reduce or eliminate the conductivity of the antistatic layer by reducing the antistatic layer thickness or completely breaking the continuity of the electrically-conductive, antistatic layer. During photographic processing of the photographic film, the protective topcoat is a chemical barrier between the processing solutions and the antistatic layer, thus preventing any chemical attack of the antistatic layer. During customer handling of the photographic films, in normal use conditions such as printing, transporting and projecting the photographic films, the abrasion resistant topcoat must prevent abrasion damage or scratching which may either reduce or eliminate the conductivity of the antistatic layer or degrade the quality of the projected image due to projection of these scratches and abrasion marks or projection of the debris that such damage to the backing layer generates. Thus, the protective, abrasion-resistant topcoat is a critical component, in combination with the antihalation undercoat layer and the antistatic layer, for providing a motion picture print film that does not require a carbon black backing layer.

It is known to use polyurethanes in protective layers overlying the antistatic layers of imaging elements as disclosed, for example, in U.S. Pat. Nos. 4,914,018, 5,310,640 and 5,360,706. However, it was neither known nor expected that polyurethanes having the particular characteristics specified herein would meet the very demanding requirements of a motion picture print film for a tough but flexible protective layer capable of resisting abrasion and scratching when the film is conveyed through a projector and capable of standing up to the repeated use to which motion picture print films are typically subjected.

DETAILED DESCRIPTION OF THE INVENTION

In a preferred embodiment of the present invention, the antistatic layer utilizes vanadium pentoxide as the antistatic agent. The use of vanadium pentoxide antistatic layers is well known in the literature. The preparation of an antistatic layer from a composition of vanadium pentoxide colloidal gel is described in U.S. Pat. Nos. 4,203,769, 5,006,451, 5,221,598 and 5,366,995. Antistatic layers containing vanadium pentoxide provide excellent protection against static charge and have the advantage of excellent transparency and their performance is not significantly dependent on ambient humidity. The excellent performance of these antistatic layers results from the particular morphology of this material. The colloidal vanadium pentoxide gel consists of entangled, high aspect ratio, flat ribbons about 50–100 angstroms wide, about 10 angstroms thick and about 1000–10,000 angstroms long. Low surface resistivities can be obtained with very low vanadium pentoxide coverage as a result of this high aspect ratio morphology. A polymer binder, such as a vinylidene chloride-containing terpolymer latex or a polyesterionomer dispersion, is perferably employed to improve the integrity of the antistatic layer and to improve adhesion to the underlying support material.

The antistatic layer of vanadium pentoxide is known to interact with components in the processing solutions. Frequently, the chemicals in the photographic processing solutions are capable of reacting with or solubilizing the conductive compounds in an antistatic layer, thus causing a diminution or complete loss of the desired antistatic properties. The result of this interaction is the loss of conductivity of the antistatic layer, thus the loss of dirt protection that a process surviving antistatic layer provides post processed film. To provide protection of the antistatic layer from interacting with components of the processing solutions, a protective topcoat is applied to the antistatic layer. This protective layer chemically isolates the antistatic layer and in the case of a backside , i.e., the side opposite to the photographic emulsion layer, antistatic layer, the protective layer may also serve to provide scratch and abrasion resistance. If a proper protective topcoat is selected, the abrasion resistance of the support onto which the antistatic layer is coated can be significantly improved for normal handling and transport conditions of photographic films. Typically, this protective layer is a glassy polymer with a glass transition temperature (Tg) of 70° C. or higher that is applied from organic solvent-based coating solutions. For example, in U.S. Pat. No. 4,203,769, the vanadium pentoxide antistatic layer may be overcoated with a protective layer comprising a blend of cellulose nitrate and a copolymer containing acrylic acid or methacrylic acid. U.S. Pat. No. 5,310,640 describes the use of vanadium pentoxide with protective overcoats that are hard and brittle, such as, polymethyl methacrylate and combinations of polysilicic acid and polyvinyl alcohol. Such brittle overcoats are functional for thermally processed films for microfiche applications, but, have inadequate performance as motion picture print film backings that require tough, flexible protective overcoats.

U.S. Pat. Nos. 5,006,451 and 5,221,598 disclose the use of polymer barrier layers applied over a vanadium pentoxide antistatic subbing layer that prevent the loss of antistatic properties in photographic film processing. These barrier layers provide excellent adhesion to overlying gelatin-containing layers, but, they do not have the physical properties necessary to be effective backside topcoats for a motion picture print film.

U.S. Pat. No. 5,366,855, describes an overcoat for an antistatic layer comprising a mixture of a film forming polymer and non-film forming polymer particles. This technique of adding a hard particle such as a polymethyl methacrylate latex to a film-forming polymer such as a polyesterionomer or polyurethane dispersion can increase the brittleness of the film-forming polymer which is undesirable in the present application for motion picture print films.

U.S. Pat. No. 4,497,917 describes core/shell latex polymer protective overcoats for antistatic layers. These latex polymers have a high glass transition temperature polymer core and a low glass transition temperature polymer shell which allows the polymer to coalesce while providing resistance to ferrotyping. These soft shell polymer latexes have only marginal scratch and abrasion resistance, however.

U.S. Pat. No. 4,997,735 relates to a vacuum contacting process for photographic elements in which the outermost layer on the backside of the photographic element comprises a polymeric binder and matte particles. A wide variety of binder materials are mentioned including polymethyl methacrylate, cellulose esters, polyesters, and polyurethanes. This patent does not teach the specific physical properties requirements for the binder polymer needed for the present application of motion picture print films, nor does it teach these backside outermost layers in combination with antihalation undercoat layers or process surviving lubricants.

European Patent Application A252550 describes a motion picture projection film element comprising a transparent support having coated thereon, in succession, a blue-sensitive silver halide emulsion layer, a red-sensitive silver halide emulsion layer, an intermediate layer, a green-sensitive silver halide emulsion layer, and an antistress layer, wherein between the support and the blue-sensitive emulsion layer is a yellow antihalation layer and between the blue-sensitive emulsion layer and the red-sensitive emulsion layer is a blue antihalation layer. This application also describes an antistatic layer comprising an electroconductive polymer such as a polystyrene sulphonic acid sodium salt on the side of the support opposite to the photographic emulsion. Without a protective topcoat such antistatic layers have poor abrasion resistance and durability for motion picture print film applications. In addition, the antistatic performance of these electroconductive polymers may be Greatly diminished after processing.

The photographic film support materials used in the practice of this invention are synthetic high molecular weight polymeric materials. These support materials may be comprised of various polymeric films, but polyester and cellulose triacetate film supports, which are well known in the art, are preferred. The thickness of the support is not critical. Support thickness of 2 to 10 mils (0.002–0.010 inches) can be employed, for example, with very satisfactory results. The polyester support typically employs an undercoat or primer layer between the antistatic layer and the polyester support. Such undercoat layers are well known in the art and comprise, for example, a vinylidene chloride/methyl acrylate/itaconic acid terpolymer or vinylidene chloride/acrylonitrile/acrylic acid terpolymer as described in U.S. Pat. Nos. 2,627,088, 2,698,235, 2,698,240, 2,943,937, 3,143,421, 3,201,249, 3,271,178 and 3,501,301.

The antihalation undercoat used in this invention function to prevent light from being reflected into the silver halide emulsion layer(s) and thereby causing an undesired spreading of the image which is known as halation. Any of the filter dyes known to the photographic art can be used in the present invention as a means of reducing halation. Thus, for example, water-soluble dyes 6an be used for this purpose. Such dyes should be incorporated in the antihalation undercoat with a mordant to prevent dye diffusion. Alternatively, and preferably, a solid particle filter dye is incorporated in the antihalation undercoat.

Useful water-soluble filter dyes for the purpose of this invention include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonyl dyes of U.S. Pat. Nos. 3,486,897, 3,652,284 and 3,718,472, the enamino hemioxonol dyes of U.S. Pat. No. 3,976,661, the cyanomethyl sulfone-derived merocyanines of U.S. Pat. 3,723,154, the thiazolidones, benzotriazoles, and thiazolothiazoles of U.S. Pat. Nos. 2,739,888, 3,253,921, 3,250,617, and 2,739,971, the triazoles of U.S. Pat. No. 3,004,896, and the hemioxonols of U.S. Pat. Nos. 34,215,597 and 4,045, 229. Useful mordants are described, for example, in U.S. Pat. Nos. 3,282,699, 3,455,693, 3,438,779, and 3,795,519.

Preferred examples of solid particle filter dyes for use in the antihalation underlayer of this invention are those described in U.S. Pat. No. 4,940,654. These solid particle filter dyes are compounds represented by the following formula(I):

$$[D\text{-}A)_y]\text{-}X_n \qquad (I)$$

where

D is a chromophoric light-absorbing moiety, which, when y is 0, comprises an aromatic ring free of carboxy substituents, A is an aromatic ring, free of carboxy substituents, bonded directly or indirectly to D, X is a substituent, other than carboxy, having an ionizable proton, either on A or on an aromatic ring portion of D, having a pKa of about 4 to 11 in a 50/50 mixture (volume basis) of ethanol and water, y is 0 to 4, n is 1 to 7, and the compound has a log partition coefficient of from about 0 to 6 when it is in unionized form.

Examples of filter dyes according to formula (I) include the following:

D-1

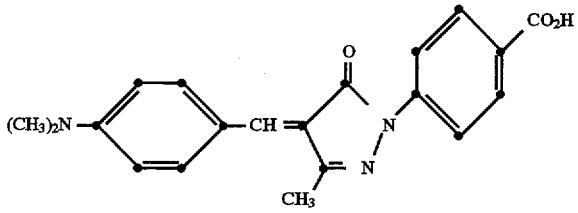

D-2

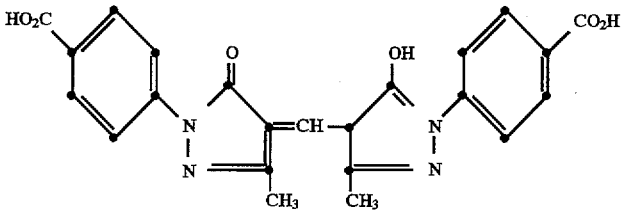

D-3

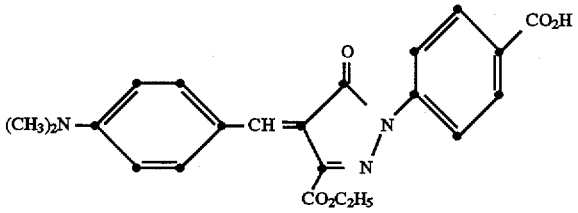

D-4

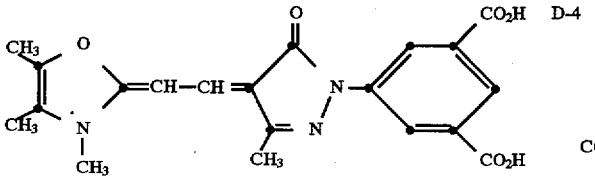

D-5

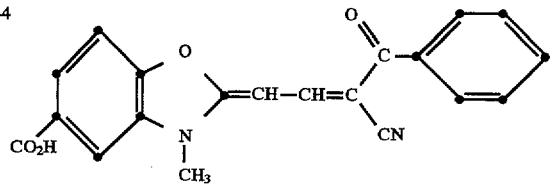

D-6

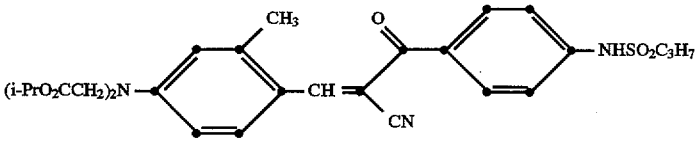

To promote adhesion of the antihalation underlayer to the support, primer layers as hereinabove described are advantageously employed, especially when the support is a polyester support.

The use of film-forming hydrophilic colloids as binders in photographic elements, including photographic films and photographic papers, is very well known. The most commonly used of these is gelatin and gelatin is a particularly preferred material for use in this invention. It can be used as the binder in the antihalation underlayer and in the silver halide emulsion layer(s). Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

The photographic elements of the present invention can be simple black-and-white or monochrome elements or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises at least one blue-sensitive silver halide effulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to an antihalation underlayer and one or more emulsion layers, the elements of the present invention can contain auxiliary layers conventional in photographic elements, such as overcoat layers, spacer layers, filter layers, interlayers, pH lowering layers (sometimes referred to as acid layers and neutralizing layers), timing layers, opaque reflecting layers, opaque light-absorbing layers and the like.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 36544, September, 1994, and the references listed therein.

The photographic silver halide emulsions utilized in this invention can contain other addenda conventional in the photographic art. Useful addenda are described, for example, in *Research Disclosure,* Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazoiotriazoles. Preferred couplers which form yellow dye images are benzoylacetanilides and pivalylacetanilides.

The protective topcoats of the present invention may be successfully employed with a variety of antistatic layers well known in the art. The antistatic layer of this invention may include a variety of electrically conductive metal-containing particles, such as metal oxides, dispersed in a binder material. Many of these metal oxide particles do not require chemical barriers to protect them against harsh environments, such as photographic processing solutions. However, since many of these metal oxides require high particle loading in a binder to obtain good conductivity, i.e. antistatic properties, the physical properties are degraded and an abrasion resistant topcoat is required for good physical durability of the layers. Examples of useful electrically conductive metal-containing particles include donor-doped metal oxides, metal oxides containing oxygen deficiencies, and conductive nitrides, carbides, and borides. Specific examples of particularly useful particles include conductive $TiO_2$, $SnO_2$, $V_2O_5$, $Al_2O_3$, $ZrO_2$, $In_2O_3$, ZnO, $ZnSb_2O_6$, $InSbO_4$, $TiB_2$, $ZrB_2$, $NbB_2$, $TAB_2$, CrB, MoB, WB, $LaB_6$, ZrN, TiN, WC, HfC, HfN, and ZrC. Examples of the patents describing these electrically conductive particles include; U.S. Pat. Nos. 4,275,103, 4,394,441, 4,416,963, 4,418,141, 4,431,764, 4,495,276, 4,571,361, 4,999,276, 5,122,445 and 5,368,995. Also included are:

Semiconductive metal salts such as cuprous iodide as described in U.S. Pat. Nos. 3,245,833, 3,428,451, and 5,075,171.

Fibrous conductive powders comprising, for example, antimony-doped tin oxide coated onto non-conductive potassium titanate whiskers as described in U.S. Pat. Nos. 4,845,369 and 5,116,666.

Conductive polymers, such as, the cross-linked vinylbenzyl quaternary ammonium polymers of U.S. Pat. Nos. 4,070,189 or the conductive polyanilines of U.S. Pat. No. 4,237,194.

A colloidal gel of vanadium pentoxide or silver-doped vanadium pentoxide as described in U.S. Pat. Nos. 4,203,769, 5,006,451, 5,221,598 and 5,284,714.

However, the preferred antistatic layer contains vanadium pentoxide as described in one of the aforementioned patents. The antistatic layer described in U.S. Pat. No. 4,203,769 is prepared by coating an aqueous colloidal solution of vanadium pentoxide. Preferably, the vanadium pentoxide is doped with silver. A polymer binder, such as a cationic vinylidene-chloride-containing terpolymer latex or a polyesterionomer dispersion, is preferably employed in the antistatic layer to improve the integrity of the layer and to improve adhesion to the undercoat layer. Typically the dried coating weight of the vanadium pentoxide antistatic material is about 0.5 to 30 mg/m$^2$. The weight ratio of polymer binder to vanadium pentoxide can range from about 1:5 to 500:1, but, preferably 1:1 to 10:1. Typically, the antistatic layer is coated at a dry coverage of from 1 to 400 mg/m$^2$ based on total dry weight. The electrical resistivity of the antistatic layer is preferably from about 7 to about 11 log Ω/□, and most preferably less than 9 log Ω/□.

The antistatic coating formulation may also contain a coating aid to improve coatability. The common level of coating aid in the antistatic coating formula is 0.01 to 0.30 weight percent active coating aid based on the total solution weight. However, the preferred level of coating aid is 0.02 to 0.20 weight percent active coating aid based on total solution weight. These coating aids can be either anionic or nonionic coating aids such as paraisononyphenoxy-glycidol ethers, octylphenoxypolyethoxy ethanol, sodium salt of alkylaryl polyether sulfonate, and dioctyl esters of sodium sulfosuccinic acid, which are commonly used in aqueous coatings. The coating may be applied onto the film support using coating methods well known in the art such as hopper coating, skim pan/air knife, gravure coating, and the like.

The antistatic layer of this invention is overcoated with a polyurethane. Preferably, the polyurethane is an aliphatic polyurethane. Aliphatic polyurethanes are preferred due to their excellent thermal and UV stability and freedom from yellowing. The polyurethanes of the present invention are characterized as those having a tensile elongation to break of at least 50% and a Young's modulus measured at an elongation of 2% of at least 50,000 lb/in$^2$. These physical property requirements insure that the topcoat layer is hard yet tough to simultaneously provide excellent abrasion resistance and outstanding resiliency to allow the topcoat and antistat layer to survive hundreds of cycles through a motion picture projector. The polyurethane topcoat is preferably coated from a coating formula containing from about 0.5 to about 10.0 weight percent of polymer to give a dry coverage of from about 50 to about 3000 mg/m$^2$. The dry coverage of the topcoat layer is preferably from about 300 to 2000 mg/m$^2$.

The polyurethane may be either organic solvent soluble or aqueous dispersible. For environmental reasons, aqueous dispersible polyurethanes are preferred. Preparation of aqueous polyurethane dispersions is well-known in the art and involves chain extending an aqueous dispersion of a prepolymer containing terminal isocyanate groups by reaction with a diamine or diol. The prepolymer is prepared byreacting a polyester, polyether, polycarbonate, or polyacrylate having terminal hydroxyl groups with excess polyfunctional isocyanate. This product is then treated with a compound that has functional groups that are reactive with an isocyanate, for example, hydroxyl groups, and a group that is capable of forming an anion, typically this is a carboxylic acid group. The anionic groups are then neutralized with a tertiary amine to form the aqueous prepolymer dispersion. The chemical resistance of the polyurethane topcoat can be improved by adding a crosslinking agent that reacts with functional groups present in the polyurethane, for example, carboxyl groups. Crosslinking agents such as aziridines, carbodiimides, epoxies, and the like are suitable for this purpose. The crosslinking agent can be used at about 0.5 to about 30 weight percent based on the polyurethane. However, a crosslinking agent concentration of about 2 to 12 weight percent based on the polyurethane is preferred.

A suitable lubricating agent should be included to give the topcoat a coefficient of friction that ensures good transport characteristics during manufacturing and customer handling of the photographic film. Many lubricating agents can be used, including higher alcohol esters of fatty acids, higher fatty acid calcium salts, metal stearates, silicone compounds, paraffins and the like as described in U.S. Pat. Nos. 2,588,756, 3,121,060, 3,295,979, 3,042,522 and 3,489,567. For satisfactory transport characteristics, the lubricated surface should have a coefficient of friction of from 0.10 to 0.40. However, the most preferred range is 0.15 to 0.30. If the topcoat coefficient of friction is below 0.15, there is a significant danger that long, slit rolls of the photographic film will become unstable in storage or shipping and become telescoped or dished, a condition common to unstable film rolls. If the coefficient of friction is above 0.30 at manufacture or becomes greater than 0.30 after photographic film processing, a common condition of non-process surviving topcoat lubricants, the photographic film transport characteristics become poorer, particularly in some types of photographic film projectors.

Aqueous dispersed lubricants are strongly preferred since lubricants, in this form, can be incorporated directly into the aqueous protective topcoat formula, thus avoiding a separately applied lubricant overcoat on the protective topcoat layer. The aqueous dispersed lubricants of carnauba wax, polyethylene oxide, microcrystalline wax, paraffin wax, silicones, stearates and amides work well as incorporated lubricants in the aqueous, protective topcoat. However, the aqueous dispersed lubricants of carnauba wax and stearates are preferred for their effectiveness in controlling friction at low lubricant levels and their excellent compatibility with aqueous dispersed polyurethanes.

In addition to lubricants, matting agents are important for improving the transport of the film on manufacturing, printing, processing, and projecting equipment. Also, these matting agents can reduce the potential for the protective topcoat to ferrotype when in contact with the emulsion side surface under the pressures that are typical of roll films. The term "ferrotyping" is used to describe the condition in which the backside protective topcoat, when in contact with the emulsion side under pressure, as in a tightly wound roll, adheres to the emulsion side sufficiently strongly that some sticking is noticed between the protective topcoat and the emulsion side surface layer when they are separated. In severe cases of ferrotyping, damage to the emulsion side surface may occur when the protective topcoat and emulsion side surface layer are separated. This severe damage may have an adverse sensitometric effect on the emulsion.

Preferably, the topcoats of the present invention contain matte particles. The matting agent may be silica, calcium carbonate, or other mineral oxides, glass spheres, ground polymers and high melting point waxes, and polymeric matte beads. Polymeric matte beads are preferred because of uniformity of shape and uniformity of size distribution. The matte particles should have a mean diameter size of about 0.5 to about 3 micrometers. However, preferably the matte particles have a mean diameter of from about 0.75 to about 2.5 micrometers. The matte particles can be employed at a dry coating weight of about 1 to about 100 mg/m$^2$. However, the preferred coating weight of the matte particles is about 15 to about 65 mg/m$^2$. The surface roughness (Ra, ANSI Standard B46.1, 1985) in microns should be in the range 0.010 to 0.060 to prevent ferrotyping of the emulsion surface. However, the preferred Ra value range is from 0.025 to 0.045 for best performance. If the Ra value is below 0.025, there is insufficient surface roughness to prevent slight emulsion surface marking from ferrotyping between the backing and emulsion. If the Ra value is above 0.045, there is sufficient surface roughness with these size matte particles to show some low level of emulsion granularity and loss of picture sharpness, especially under the very high magnifications typical of movie theater projection.

The following examples are intended to illustrate the present invention but not to limit it in scope in any way. The percents in these examples are in weight percentage. The polymer topcoats used in the examples are described in Table 1. The modulus and elongation to break were determined according to the procedures set forth in ASTM D882 for cast films that were 4 inches long, 0.25 inches wide and 100 micrometers thick. The polyurethane films contained 3% (based on polymer weight) of an aziridine crosslinking agent. All films were cured for 4 hours at 100° C. prior to testing. The modulus was determined from the slope of the stress versus strain curve at an elongation of 2%.

TABLE 1

| Polymer | Description | Modulus, lb/in$^2$ | Elongation to Break, % |
|---|---|---|---|
| P-1 | Polymethyl methacrylate (ICI Elvacite 2041) | 380,000 | 1 |
| P-2 | Cellulose diacetate (Eastman Chemical Co.) | 450,000 | 5 |
| P-3 | Witcobond 232 (Witco Corporation)* | 103,000 | 150 |
| P-4 | Witcobond 234 (Witco Corporation)* | 31,000 | 350 |
| P-5 | Witcobond 242 (Witco Corporation)* | 73,000 | 50 |
| P-6 | Witcobond 240 (Witco Corporation)* | 118,000 | 70 |
| P-7 | Sancure 898(B. F. Goodrich Company)* | 115,000 | 210 |
| P-8 | Sancure 815D(B. F. Goodrich Company)* | 180,000 | 220 |
| P-9 | Sarcure 12684(B. F. Goodrich Company)* | 86,000 | 320 |
| P-10 | Neorez 972 (Zeneca Resins)* | 5,100 | 500 |

*Each of P-3 to P-10 is a polyurethane resin.

EXAMPLES 1 TO 6 AND COMPARATIVE SAMPLES A TO E

A subbed polyester support was prepared by first applying a subbing terpolymer of acrylonitrile, vinylidene chloride and acrylic acid to both sides of the support before drafting and tentering so that the final coating weight was about 90 mg/m$^2$.

An antihalation underlayer formulation consisting of the following components was prepared at 1.75% total solids:

| | |
|---|---|
| Gelatin | 1.35% |
| Solid particle dye D-1 | 0.35% |
| Dihydroxy dioxane gelatin hardener | 0.04% |
| Dixie Chemical Co., 10G surfactant, 10% | 0.1% |
| Demineralized water | 98.16% |

The antihalation formulation was coated on one side of the subbed support to give a total dry coating weight of 350 mg/m$^2$.

An antistatic formulation consisting of the following components was prepared at 0.078% total solids:

| | |
|---|---|
| Eastman Chemicals polyesterionomer, AQ29D, 30% | 0.094% |
| Vanadium pentoxide colloidal dispersion, 0.57% | 4.972% |
| Rohm & Haas surfactant, Triton X-100, 10% | 0.212% |
| Demineralized water | 94.722% |

The antistatic formulation was coated over the subbed polyester support on the side opposite to the antihalation layer to give a dry coating weight of about 12 mg/m$^2$. Then, a protective topcoat formulation was used to overcoat the antistatic layer. The protective topcoat formulation consisted of the following components:

| | % wet | % dry |
|---|---|---|
| Polyurethane dispersion, 30% | 26.60% | 90.38% |
| Pentaerythrityl tetra-stearate wax dispersion, 45% | 0.02% | 0.10% |

-continued

| | % wet | % dry |
|---|---|---|
| Matte, polymethyl methacrylate beads, 2 μm, 23.8% | 1.10% | 3.07% |
| Polyfunctional aziridine crosslinker, 50% | 0.98% | 5.75% |
| Rohm & Haas surfactant, Triton X-100, 10% | 0.60% | 0.70% |
| Demineralized water | 71.61% | — |

Two conventional topcoat materials, polymethyl methacrylate, P-1, and cellulose diacetate, P-2, were applied from a methylene chloride solution. A small amount of surfactant, Dow Corning 510 silicone fluid, was added to the coating solutions to improve the coating appearance and surface quality. The dry coating weight for all the topcoat polymers was 1000 mg/m$^2$.

The antihalation undercoat layer was then overcoated with silver halide emulsion layers suitable for color motion picture print film and a conventional emulsion overcoat containing 1000 mg/m$^2$ gelatin, 5 mg/m$^2$ of 2 μm polymer matte and polydimethyl siloxane lubricant.

The sample films comprising the antihalation undercoat, antistatic layer, and protective topcoat were tested for Taber abrasion resistance, ferrotyping behavior, coefficient of friction, and resistivity in laboratory tests and evaluated in practical use tests for Motion Picture photographic films. The results were compared with a conventional motion picture film on polyester support comprising a carbon black-containing backing layer (sample E). Prior to all testing except ferrotyping behavior, this conventional film was processed to remove the carbon black-containing layer, thus the backside of the film was bare polyester support. Taber abrasion tests were performed in accordance with the procedures set forth in ASTM D1044; the performance in the Taber abrasion test was judged as excellent for abraded haze values less than or equal to 10% haze, good for samples with an abraded haze value greater than 10% and less than or equal to 15%, and poor for samples with an abraded haze value greater than 15%.

Two practical tests were performed on these samples to determine the abrasion or scratch resistance under actual use conditions for photographic film. The first of these two tests is a Sprocket Drive Test which simulates high speed processing through a Motion Picture film processor. The Sprocket Drive film processors transport the film on sprocket drive wheels which can damage the film around the perforations into which the sprocket teeth of the drive wheels engage during transport of the film. After the film is transported through the Sprocket Drive Test the correct number of passes to simulate a normal production process, the film is removed and examined under an optical microscope around the perforation holes for abrasion or scratching. The film was rated as excellent, good, or poor based on this microscopic examination.

The second practical test for determining abrasion or scratch resistance of the protective topcoats is a Projector Abrasion Test. In this test, a continuous loop of processed film is passed through a Motion Picture photographic film projector for 200 passes to simulate about the normal film life in a movie theater. The tested film is removed from the Projector Abrasion Tester and examined for abrasion or scratches around the perforation holes in those areas in which the film surface contacted the projector. The film was rated as excellent, good, or poor based on this examination.

The films were processed in a conventional motion picture film processor and the internal resistivity of the films (internal resistivity measured according to: R. A. Elder, Proc. EOS/ESD Sympos., EOS-12, pgs. 251-4, September 1990) and the coefficient of friction were measured after processing.

The ferrotyping behavior of the sample films was evaluated by winding 50 foot lengths of each film onto 2 inch diameter plastic cores and keeping the rolls for 3 days at 100° F. and 60% RH. The films were examined both before and after processing to evaluate ferrotyping behavior, the performance in this test was judged to be poor if any of the following were observed: sticking together of the roll (i.e., "blocking"), significant changes in surface gloss of the emulsion overcoat, or any defects in the processed image such as pressure marks as a result of being wound on a core.

The description of the samples and the results for the aforementioned tests are tabulated in Table 2.

TABLE 2

| Sample | Topcoat | Taber Abrasion | Sprocket Drive Test | Projector Abrasion Test | Ferro-typing Rating |
|---|---|---|---|---|---|
| Sample A | P-1 | Excellent | Good | Poor | Good |
| Sample B | P-2 | Excellent | Poor | Poor | Good |
| Sample C | P-4 | Good | Good | Good | Poor |
| Sample D | P-10 | Poor | Poor | Poor | Poor |

TABLE 2-continued

| Sample | Topcoat | Taber Abrasion | Sprocket Drive Test | Projector Abrasion Test | Ferro-typing Rating |
|---|---|---|---|---|---|
| Sample E | conventional print film* | Good | Good | Good | Good |
| Example 1 | P-3 | Excellent | Good | Excellent | Good |
| Example 2 | P-5 | Excellent | Excellent | Excellent | Good |
| Example 3 | P-6 | Good | Excellent | Excellent | Good |
| Example 4 | P-7 | Excellent | Good | Excellent | Good |
| Example 5 | P-8 | Excellent | Good | Excellent | Good |
| Example 6 | P-9 | Good | Good | Excellent | Good |

*unprocessed film with carbon black in cellulosic binder and carnauba wax overcoat used for ferrotyping test, all other tests used processed film with carbon black layer removed.

After processing, the films of examples 1 to 6 had an internal resistivity value less than 9 log Ω/□ and a coefficient of friction less than 0.30 compared with sample E which had an internal resistivity greater than 14 log Ω/□ and a coefficient of friction greater than 0.4.

Only polyurethane topcoats of the invention provide good or excellent performance in all the test results listed in Table 2 and provide excellent surface resistivities and friction coefficients after processing. Topcoat materials that are well known in the art and have a high modulus but low elongations to break, such as those of sample A and sample B, have excellent Taber abrasion resistance but give poor performance in tests which simulate the high speed film processing and movie theater protection typical of motion picture print film use. Polyurethanes that have a modulus less than 50,000 lb/in$^2$ such as P-4 and P-10, give poor ferrotyping performance or perform poorly in all of the above tests.

EXAMPLE 7

A subbed polyester support containing an antihalation undercoat layer, silver halide emulsion layers, and an emulsion overcoat as described in examples 1 to 6 was coated on the opposite side with an antistatic layer containing the crosslinked vinylbenzyl ammonium chloride conductive polymer described in U.S. Pat. No. 4,070,189 and a cationic vinylidene chloride terpolymer latex. The antistatic layer contained 40%. conductive polymer and 60% terpolymer latex and was applied at a total dried coating weight of 300 mg/m$^2$. The antistatic layer was then overcoated with the topcoat formulation of example 1. The film sample was tested in a similar manner to the previous examples and found to give a processed resistivity of 10 log Ω/□ and was rated good or excellent for Taber abrasion, projector abrasion and sprocket drive test performance, and ferrotyping.

The invention has been described in detail, with particular reference to certain preferred embodiments thereof, but it should be understood that variations and modifications can be effected within the spirit and scope of the invention.

We claim:

1. A motion picture print film comprising a support having, in order, on one side thereof an antihalation undercoat and at least one silver halide emulsion layer and having, in order, on the opposite side thereof an antistatic layer and a protective topcoat; wherein said protective topcoat is comprised of a polyurethane binder and a lubricant and said polyurethane binder has a tensile elongation to break of at least 50% and a Young's modulus measured at a 2% elongation of at least 50000 lb/in$^2$.

2. A motion picture print film as claimed in claim 1, wherein said support is a polyester film.

3. A motion picture print film as claimed in claim 1, wherein said support is a cellulose triacetate film.

4. A motion picture print film as claimed in claim 1, wherein said antihalation undercoat comprises a solid particle filter dye.

5. A motion picture print film as claimed in claim 1, wherein said antistatic layer comprises electrically-conductive metal-containing particles selected from the group consisting of donor-doped metal oxides, metal oxides containing oxygen deficiencies, conductive nitrides, conductive carbides and conductive borides.

6. A motion picture print film as claimed in claim 1, wherein said antistatic layer comprises an electrically-conductive polymer.

7. A motion picture print film as claimed in claim 1, wherein said antistatic layer comprises vanadium pentoxide.

8. A motion picture print film as claimed in claim 1, wherein said antistatic layer has a dry coverage of from 1 to 400 $mg/m^2$.

9. A motion picture print film as claimed in claim 1, wherein said antistatic layer has an electrical resistivity of less than 9 log ohms per square.

10. A motion picture print film as claimed in claim 1, wherein said topcoat has a dry coverage of from about 50 to about 3000 $mg/m^2$.

11. A motion picture print film as claimed in claim 1, wherein said polyurethane binder is an aliphatic polyurethane.

12. A motion picture print film as claimed in claim 1, wherein said polyurethane binder is an aqueous-dispersible polyurethane.

13. A motion picture print film as claimed in claim 1, wherein said polyurethane binder is crosslinked by a crosslinking agent.

14. A motion picture print film as claimed in claim 1, wherein said lubricant is an aqueous-dispersible lubricant.

15. A motion picture print film as claimed in claim 1, wherein said topcoat has a coefficient of friction in the range of from 0.15 to 0.30.

16. A motion picture print film as claimed in claim 1, wherein said topcoat additionally comprises matte particles having a mean diameter in the range of from about 0.5 to about 3 micrometers.

17. A motion picture print film as claimed in claim 16, wherein said matte particles have a dry coating weight of about 15 to about 65 $mg/m^2$.

18. A motion picture print film as claimed in claim 1, wherein the surface roughness of said topcoat is in the range of from 0. 025 to 0. 045.

19. A motion picture print film as claimed in claim 1, additionally comprising a gelatin overcoat overlying said at least one silver halide emulsion layer.

20. A motion picture print film comprising a polyester support having, in order, on one side thereof an antihalation undercoat and at least one silver halide emulsion layer and having, in order, on the opposite side thereof an antistatic layer and a protective topcoat; wherein said antihalation undercoat comprises a solid particle filter dye dispersed in gelatin; said antistatic layer comprises vanadium pentoxide dispersed in a polyesterionomer; said protective topcoat is comprised of a stearate wax dispersed in a polyurethane binder and said polyurethane binder is an aqueous-dispersible aliphatic polyurethane which has a tensile elongation to break of at least 50% and a Young's modulus measured at 2% elongation of at least 50000 $lb/in^2$.

21. A motion picture print film comprising a polyester support having, in order, on one side thereof an antihalation undercoat and at least one silver halide emulsion layer and having, in order, on the opposite side thereof an antistatic layer and a protective topcoat; wherein said antihalation undercoat comprises a solid particle filter dye dispersed in gelatin; said antistatic layer comprises vanadium pentoxide dispersed in a vinylidene-chloride-containing terpolymer latex; said protective topcoat is comprised of carnauba wax dispersed in a polyurethane binder and said polyurethane binder is an aqueous-dispersible aliphatic polyurethane which has a tensile elongation to break of at least 50% and a Young's modulus measured at 2% elongation of at least 50000 $lb/in^2$.

22. A motion picture print film comprising a polyester support having, in order, on one side thereof an antihalation undercoat and at least one silver halide emulsion layer and having, in order, on the opposite side thereof an antistatic layer and a protective topcoat; wherein said antihalation undercoat comprises a solid particle filter dye dispersed in gelatin; said antistatic layer comprises a crosslinked vinylbenzyl ammonium chloride conductive polymer and a cationic vinylidene-chloride-containing terpolymer latex; said protective topcoat is comprised of a stearate wax dispersed in a polyurethane binder and said polyurethane binder is an aqueous-dispersible aliphatic polyurethane which has a tensile elongation to break of at least 50% and a Young's modulus measured at 2% elongation of at least 50000 $lbs/in^2$.

* * * * *